US005917162A

United States Patent [19]

Jackman

[11] Patent Number: 5,917,162

[45] Date of Patent: Jun. 29, 1999

[54] CIRCUIT BREAKER WITH MULTIPLE OPERATORS FOR ACTUATOR DEVICE

[75] Inventor: Peter Jackman, Hants, United Kingdom

[73] Assignee: First Inertia Switch Limited, United Kingdom

[21] Appl. No.: 08/871,408

[22] Filed: Jun. 9, 1997

[51] Int. Cl.[6] ..... H01H 35/14

[52] U.S. Cl. ..... 200/61.45 R; 200/61.53; 200/330; 200/518

[58] Field of Search ..... 200/518, 61.53, 200/330, 331, 42.01, 61.45 R, 61.45 M

[56] References Cited

U.S. PATENT DOCUMENTS 1,713,199 5/1929 Trott ..... 200/5 R
3,226,504 12/1965 Gallistel et al. ..... 200/61.53
3,827,039 7/1974 Agnese ..... 200/331 X
4,103,697 8/1978 Kiesow ..... 200/61.53 X
4,533,801 8/1985 Jackman et al. .

*Primary Examiner*—Renee S. Luebke
*Attorney, Agent, or Firm*—Larson & Taylor

[57] ABSTRACT

An electrical switch has a movable contact 15 and a fixed contact 14. A member 26 can move the contact 15 to make or break the switch. A latch including a movable device controls the initial movement of member 26 but the member 26 then moves independently of the latch. The device can be moved to release the latch either manually (by 31) or by another mechanism. This other mechanism can be an electromagnet 41; it also can be an inertia body 51 releasable from a rest position in response to excessive acceleration.

5 Claims, 3 Drawing Sheets

CIRCUIT BREAKER WITH MULTIPLE OPERATORS FOR ACTUATOR DEVICE

For electrical safety in vehicles, it is often desired to break the electrical circuits in response to various events, including excessive acceleration, activation from a remote location and manual operation.

Various aspects of the invention are directed to a circuit breaker responsive to a selection from such events and a further aspect of the invention is directed to a circuit breaker with interchangeable parts to allow it to be responsive to one or more of the listed events according to various interchangeable parts incorporated.

According to the invention there is provided an electrical switch comprising a fixed contact, a movable contact movable to change the state of electrical connection with the fixed contact, a device movable to an operative position for causing the movable contact to change the state of electrical connection with the fixed contact from a first state to a second state, first means for moving said device to said operative position and manually operable means for moving said device to said operative position.

Preferably the device comprises a latch releasable by said first means and releasable by said manually operable means and means movable on release of said latch movable to change the state of electrical connection with the fixed contact from the first state to the second state independently of the movement of the first means and/or the manually operable means.

The manually operable means is preferably arranged to move said device independently of the first means.

The switch may also comprise resetting means for moving said means movable on release of said latch in the opposite direction to allow the latch to be reset.

In one arrangement the first means may comprise an electromagnet having an armature movable to move said device. In another arrangement the first means may comprise an inertia body movable in response to an acceleration over a given threshold within a chamber to move said device. In this case, the manually operable means preferably includes a member extending around the outside of said chamber and may comprise a plurality of members spaced around said chamber. When the plurality of members spaced around the chamber are provided, a spider may be provided, with a number of arms equal to the number of said members spaced around the chamber. In this case, the centre of the spider is preferably the region which engages the device.

An example of the invention will now be described with reference to the accompanying drawings in which.

Figure 1:
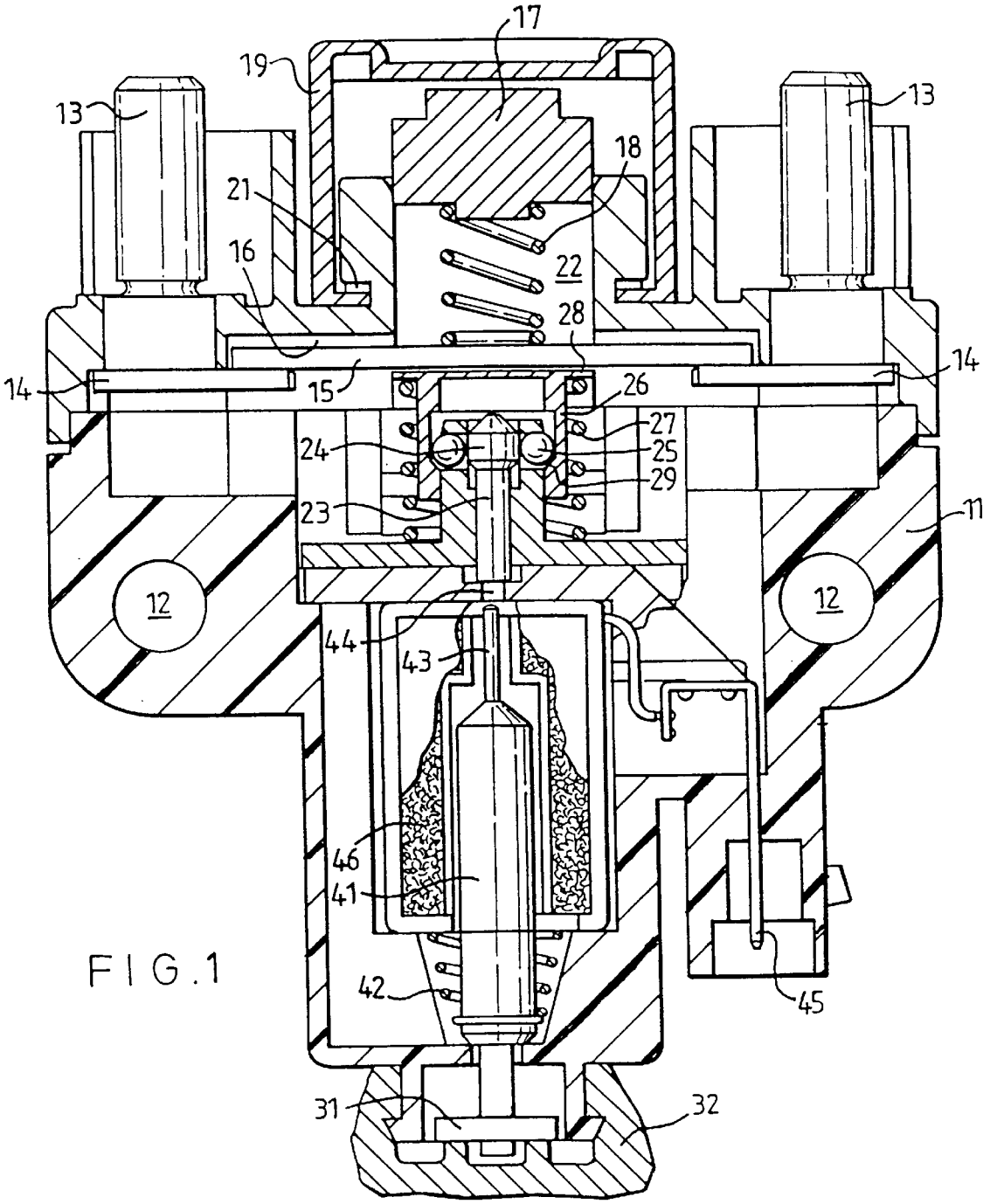
FIG. 1 is a section through a first embodiment of the invention.
Figures 2A, 2B:
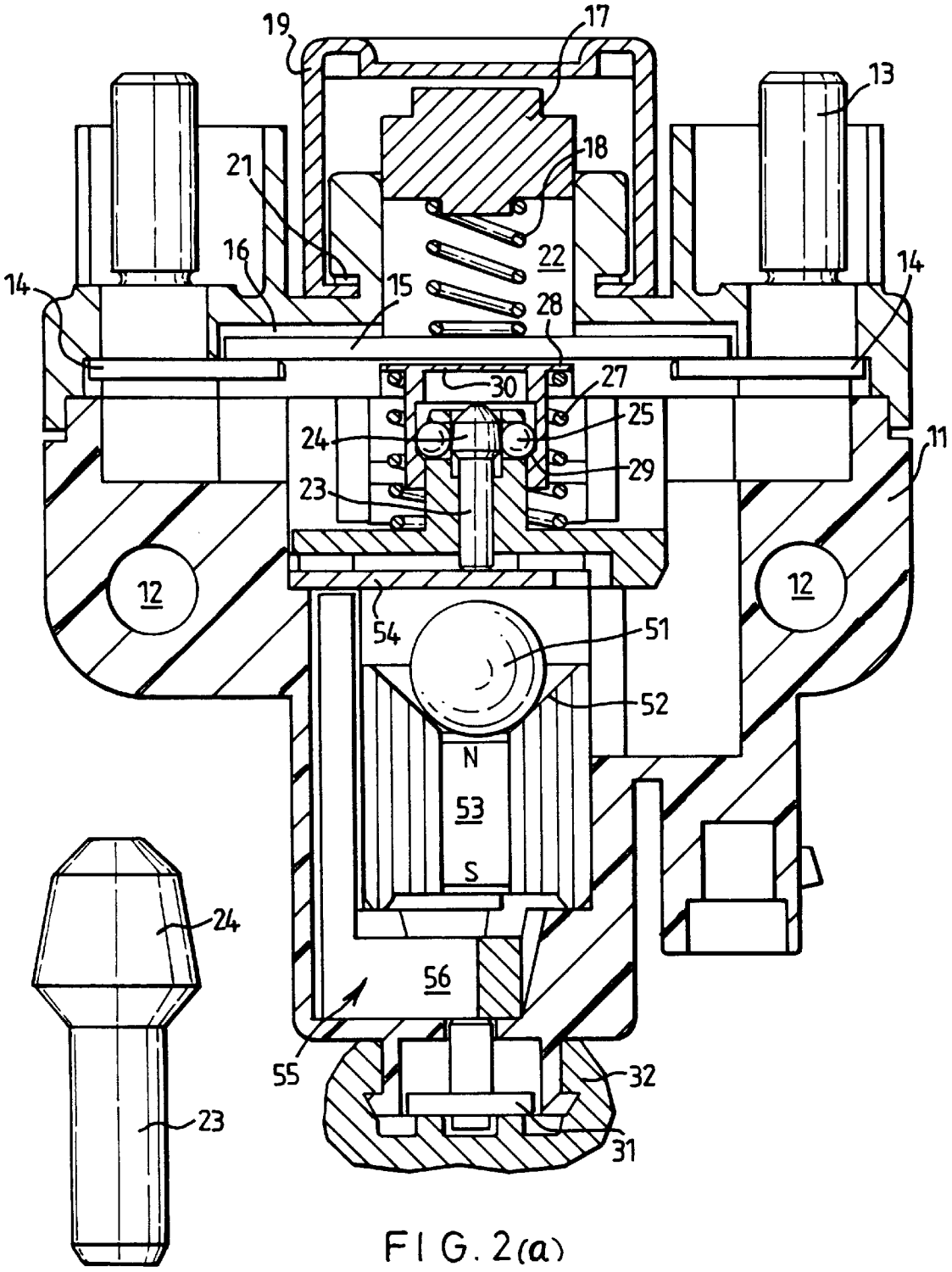
FIG. 2 is a section through a second alternative embodiment of the invention, FIG. 2(*a*) is a side elevational view of the plunger of FIGS. 1 and 2, FIG. 3(*a*) is an exploded perspective view of the first embodiment of the invention, and FIG. 3(*b*) is an exploded perspective view of the components of the second embodiment which are not common to the first embodiment.

The parts common to FIGS. 1 and 2 include a casing 11 of insulating material formed with two fixing holes 12 by which the circuit breaker can be attached to the structure where it is intended to be used. There are two fixed terminals 13, one on either side, each connected to an inwardly directed fixed contact 14 which can be bridged by a movable contact 15 extending across the center of the circuit breaker.

The movable contact is shown in its lower position bridging the two fixed contacts and the casing provides a space 16 above the movable contact to allow it to rise to break the conductive path between the two fixed contacts. Above the movable contact is a reset button 17 supported on the movable contact by a compression spring 18 and covered by a flexible cover 19 secured on the casing by lips entering a groove 21. The cover protects the reset button and the channel 22 within the top of the casing against ingress of dirt and moisture.

Below the movable contact is a device in the form of cylindrical plunger 23 with an enlarged head 24 which in the primed position of the circuit breaker is aligned with a number of balls 25 supported for radial movement in a hollow cylindrical support and engaging the bore of a hollow cylindrical member 26 which in the primed position of the circuit breaker is spaced slightly from the underside of the movable contact. The member 26 is fixedly connected to the button 17 for movement therewith. When the member 26 is in its lower latched position as shown in FIG. 1, the spring 18 biases the movable contact 16 into electrical connection with the contacts 14. A spring 27 engages the underside of an upper lip 28 on the cylindrical member to bias it upwards and the bore of the member has an inwardly and upwardly directed shoulder 29 which engages the balls. In the primed position of the circuit breaker, the cylindrical member cannot move upwards under the bias of the spring because the shoulders engage the balls which are prevented from radially inward movement by the head 24. These components thus form a latch which is released by upwards movement of the plunger 23 when its enlarged head 24 rises above the centers of the balls and allows the balls to move inwards to its thinner shank and thereby disengage the shoulder 29 on the cylindrical member, allowing it then to move upwards under the bias of its spring 27 to engage the underside of the movable contact 15 and lift it away from the fixed contacts 14, thus breaking the circuit between the terminals 13. The latch is reset by depressing the button 17 and with it the member 26 until the shoulder 29 drops below the level of the balls 25 to allow them to move radially outwards. The member 26 has a bridge 30 below the level of the movable contact 15 and on further depression of the button 17 the bridge assists gravity in returning the plunger 23 to its lower, primed, position. The enlarged head 24 of the cylindrical plunger is slightly tapered from a wider diameter at its lower end to a narrower diameter at its top end to discourage upwards movement of the plunger 23 to release the latch due to general vibration of the circuit breaker as a whole. The taper is shown in exaggerated form in FIG. 2(*a*).

At the base of the casing is a manual activating button 31 within a flexible cover 32. A mechanical linkage to be described later transmits upwards movement of the button 31 to the plunger 23.

Figure 3A:
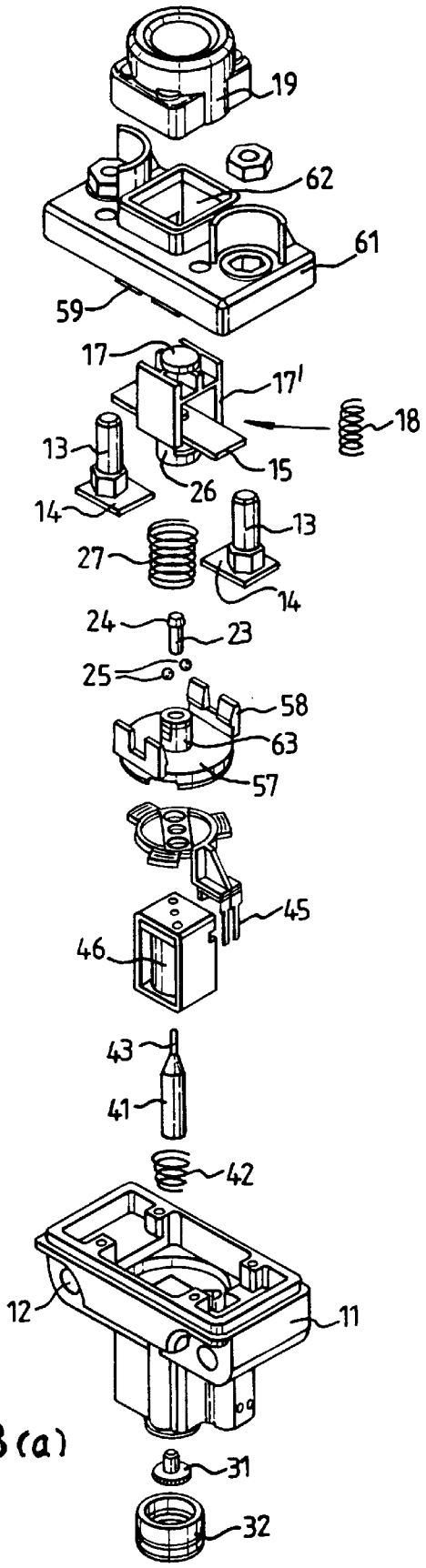
Figure 3B:
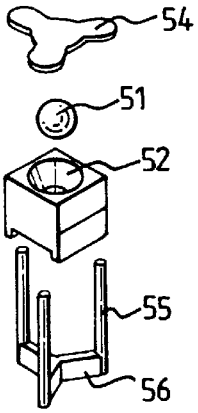

The exploded views shown in FIGS. 3(*a*) and 3(*b*) make it clear the parts of the apparatus which are common to all versions and those components which are applicable to the embodiment of FIG. 1 including the components 41 to 46 in FIG. 3(*a*) and the embodiment of FIG. 2 including the components 51 to 56 as shown in FIG. 3(*b*). All the other components so far described are common to both embodiments.

The latch can be released by two different means. The first means has two different embodiments, described respectively with reference to FIGS. 1 and 2. The second means is the manually operable button 31 and its associated mechanical linkage.

In FIG. 1, the first means for moving the plunger 23 is formed by an armature 41 of a solenoid biased downwardly by a spring 42 and provided with a narrow neck 43 at its top end which passes through an aperture 44 in the casing to engage the base of the cylindrical plunger 23. The rim of the aperture in the structure provides a lower stop for the cylindrical plunger after it has been returned to its primed position by depression of the reset button 17. Electrical contacts 45 are provided on the right-hand side of the casing leading to the coil 46 of the electromagnet which on energisation causes the armature to rise against the bias of its spring so that the top of the narrow neck engages the underside of the cylindrical plunger to lift it upwards and allow the balls to move radially inwards and release the cylindrical member to rise against the movable contact and break the electrical connection. In this embodiment the button 31 acts through a mechanical linkage in the form of the armature 41 to raise the plunger 23.

In the embodiment of FIG. 2 the electromagnet and its armature are replaced by an inertia sensor of generally conventional construction. This comprises a spherical inertia body 51 normally resting in a conical seat and biased to its rest position by the attraction of a permanent magnet below the conical seat. A three-armed spider 54 rests above the inertia body and supports the base of the plunger.

In FIG. 2 the connection between the manual activating button and the plunger is provided by a three-armed cage 55 around the inertia sensor engaging at its top end the three arms of the spider 54 and having a base 56 extending across the upper end of the manual activating button 31. The button 31 therefore acts independently of the inertia sensor to move the spider 54.

When the circuit breaker of FIG. 2 experiences an excessive acceleration which causes the inertia body 51 to leave its rest position against the attraction of the magnet 53, the spider 54 is lifted by the body 51 to raise the plunger 23 and allow the balls to move radially inwards as already described. Similarly, depression of the manually activating button 31 will lift the cage 55 and thereby lift the spider 54 with the same effect. Once the experienced acceleration decreases, the inertia body 51 will return to its rest position and the apparatus can be reset by pressing the reset button 17 as already described.

It will be clear from FIG. 3(*a*) that the components common to both embodiments above the sets of alternative components snap together to form a complete sub-assembly. As can be seen from FIG. 3(*a*), there is a base 57 with upstanding resilient arms 58 formed with downwardly directed shoulders which engage corresponding latches 59 on the upper portion 61 of the casing 11. The portion 61 contains the two shielded holes for the terminals 13 and has a central rectangular enclosure 62 under which the groove 21 is formed over which the flexible cap 19 fits. The movable contact 15 is mounted in a cage providing the connection between the button 17 and the member 26. The plunger 23 and the balls 25 are duly assembled in the central column 63 of the base 57.

The lower portion of the casing 11 defines the chamber for the seat 52 for the inertia body 51 or the coil 46 for the electromagnet plunger 41 and their associated components. Once the sub-assembly described above has been put together, the appropriate set of components 41 to 46 or 51 to 56 are assembled within the lower portion and then the two portions of the casing are secured together to form the complete circuit breaker.

I claim:

1. An electrical switch comprising a fixed contact, a movable contact movable to change the state of electrical connection with the fixed contact, a device linearly movable along an axis of movement to an operative position for causing the movable contact to change the state of electrical connection with the fixed contact from a first state to a second state, first means for producing a force acting substantially along said axis of movement of said device for moving said device to said operative position and separate, manually operable means for producing a force acting substantially along said axis of movement of said device for moving said device to said operative position, said first means comprising an inertia body movable within a chamber to move said device.

2. A switch as claimed in claim 1 wherein the manually operable means comprises a member extending around the outside of said chamber.

3. A switch as claimed in claim 2 wherein the manually operable means comprises a plurality of members spaced around said chamber.

4. A switch as claimed in claim 3 comprising a spider with a number of arms equal to the number of said members spaced around the chamber.

5. A switch as claimed in claim 4 wherein the spider has a center region which engages the device.

* * * * *